US012747647B1

(12) United States Patent
Zhao et al.

(10) Patent No.: US 12,747,647 B1
(45) Date of Patent: Sep. 29, 2026

(54) HIGH TEMPERATURE HIGH PRESSURE INDUCED MINERALIZATION FOR SEALING APPLICATION

(71) Applicants: CNPC USA CORPORATION, Houston, TX (US); BEIJING HUAMEI, INC., Beijing (CN); CHINA NATIONAL PETROLEUM CORPORATION, Beijing (CN)

(72) Inventors: Lei Zhao, Houston, TX (US); Jiaxiang Ren, Houston, TX (US); Timothy Ryan Dunne, Houston, TX (US); Yu Liu, Beijing (CN); Kwami Roberts, Houston, TX (US); Peng Cheng, Houston, TX (US)

(73) Assignees: CNPC USA CORPORATION, Houston, TX (US); BEIJING HUAMEI, INC., Beijing (CN); CHINA NATIONAL PETROLEIUM CORPORATION, Beijing (CN)

( * ) Notice: Subject to any disclaimer, the term of this patent is extended or adjusted under 35 U.S.C. 154(b) by 0 days.

(21) Appl. No.: 19/253,798

(22) Filed: Jun. 28, 2025

Related U.S. Application Data

(63) Continuation-in-part of application No. 18/447,833, filed on Aug. 10, 2023, now Pat. No. 12,365,826.

(51) Int. Cl.
*E21B 33/12* (2006.01)

(52) U.S. Cl.
CPC ..... *E21B 33/1212* (2013.01)

(58) Field of Classification Search
CPC .. E21B 33/1208; E21B 33/12; E21B 33/1212; E21B 33/1277; E21B 33/127
See application file for complete search history.

(56) References Cited

U.S. PATENT DOCUMENTS

2005/0110217 A1* 5/2005 Wood ..... E21B 33/127 277/333
2018/0148991 A1* 5/2018 Hearn ..... H01L 25/50
2020/0370391 A1* 11/2020 Fripp ..... E21B 33/1212

* cited by examiner

*Primary Examiner* — Yanick A Akaragwe
(74) *Attorney, Agent, or Firm* — Frank Gao, Esq.

(57) ABSTRACT

The patent application discloses an in-situ swellable composition suitable for use in subterranean wells. The swellable packer may comprise a swellable sealing element and a geopolymer. The swellable sealing element may comprise a metal, metal alloy, or a combination thereof. The swellable metal sealing element may be configured to react with a brine to form a metal hydroxide reaction product which forms a permanent seal with an adjacent surface.

13 Claims, 6 Drawing Sheets

HIGH TEMPERATURE HIGH PRESSURE INDUCED MINERALIZATION FOR SEALING APPLICATION

CROSS REFERENCE TO RELATED APPLICATION

This patent application arises from a continuation-in-part of U.S. patent application Ser. No. 18/447,833, which was filed on Aug. 10, 2023, which is incorporated by reference by entirety.

TECHNICAL FIELD AND INDUSTRIAL APPLICABILITY

The invention disclosure relates to a packer or plug in oil and gas field, in particular, a high temperature high pressure induced mineralization for sealing application.

BACKGROUND

In the course of treating and preparing subterranean wells for production, a well packer is run into the well on a work string or a production tubing. The purpose of the packer is to support production tubing and other completion equipment, such as a screen adjacent to a producing formation, and to seal the annulus between the outside the production tubing and the inside of the well casing to block movement of fluids through the annulus past the packer location. The packer is provided with anchor slips having opposed camming surfaces, which cooperate with complementary opposed wedging surfaces, whereby the anchor slips are radially extendible into gripping engagement against the well casing bore in response to relative axial movement of the wedging surfaces.

The packer also carries annular seal elements, which are expandable radially into sealing engagement against the bore of the well casing in response to axial compression forces. Longitudinal movement of the packer components, which set the anchor slips and the sealing elements, may be produced either hydraulically or mechanically.

After the packer has been set and sealed against the well casing bore, it should maintain sealing engagement upon removal of the hydraulic or mechanical setting force. Moreover, it is essential that the packer remain locked in its set and sealed configuration while withstanding hydraulic pressures applied externally or internally from the formation and/or manipulation of the tubing string and service tools without unsetting the packer or interrupting the seal. This is made more difficult in deep wells in which the packer and its components are subjected to high downhole temperatures, for example, as high as 600 degrees F., and high downhole pressures, for example, 5,000 pounds per square inch ("psi"). Moreover, the packer should be able to withstand variation of externally applied hydraulic pressures at levels up to as much as 15,000 psi in both directions.

There is a need, therefore, for a packer that can effectively seal the wellbore at high temperature and pressure wellbore conditions.

SUMMARY

In one aspect, one embodiment discloses a swellable packer. The swellable packer comprises a swellable sealing element comprising a metal, metal alloy, or a combination thereof; and a geopolymer. The swellable metal sealing element is configured to react with a brine to form a metal hydroxide reaction product which forms a permanent seal with an adjacent surface.

Optionally in any aspect, the metal is selected from the group consisting of magnesium, copper, aluminum, zinc, nickel, Gd, and any combination thereof.

Optionally in any aspect, the metal alloy comprises a metal selected from the group consisting of magnesium, copper, aluminum, zinc, nickel, Gd, and any combination thereof.

Optionally in any aspect, the swellable sealing element comprises about 0.05 wt % to about 3.00 wt % Copper or Nickel or Iron.

Optionally in any aspect, the swellable sealing element further comprises from about 0.01 wt % to about 10 wt % geopolymer.

Optionally in any aspect, the swellable sealing element further comprises a balance of Mg.

Further in another aspect, one embodiment discloses a system for forming a seal in a wellbore. The system comprises a swellable packer and a conduit. The swellable packer may comprise about 0.01 wt % to about 10 wt % geopolymer. The swellable sealing element is configured to irreversibly react with a brine to form a metal hydroxide reaction product which forms a permanent seal with an adjacent surface. The swellable packer is disposed on the conduit.

Optionally in any aspect, the swellable sealing element comprises about 0.05 wt % to about 3.00 wt % Copper or Nickel or Iron.

Optionally in any aspect, the swellable sealing element comprises a balance of Mg.

Further in another aspect, one embodiment discloses a method for manufacturing swellable compositions suitable for use in subterranean wells. The method comprises steps of providing a cylindrical body having a backup piece, wherein the cylindrical body comprises a swellable metal sealing element having a first volume; wherein the cylindrical body is disposed on a conduit in the wellbore, wherein the swellable metal sealing element comprises a geopolymer, exposing the swellable metal sealing element to water to irreversibly react the swellable metal sealing element with the water to produce a metal hydroxide reaction product having a second volume greater than the first volume, and contacting a surface adjacent to the swellable metal sealing element with the metal hydroxide reaction product to form a permanent seal with the metal hydroxide reaction product.

Optionally in any aspects, the swellable metal sealing element comprising metal or metal alloy comprises a metal selected from the group consisting of magnesium, calcium, aluminum, copper, nickel, Iron, zinc, and any combination thereof.

Optionally in any aspects, the compact has pores, wherein the pores have porosity from about 0.5% to about 10%.

Optionally in any aspects, the inert oxide volume percent is from about 20% to about 60%.

Optionally in any aspects, the adjacent surface is a wall of the wellbore.

Optionally in any aspects, the method further comprises steps of forming a corrosion resistant seal at the presence of water under high pressure high temperature at downhole.

Optionally in any aspect, the geopolymer is about 0.01 wt % to about 10 wt.

Optionally in any aspect, the swellable packer further comprises about 0.05 wt % to about 3.00 wt % Copper or Nickel or Iron.

Optionally in any aspect, the swellable metal sealing element comprise a balance of Mg.

Optionally in any aspect, the method further comprises inducing mineralization under high temperature and high pressure.

Optionally in any aspect, the geopolymer comprises clay.

Optionally in any aspect, the geopolymer comprises montmorillonite.

In one aspect, one embodiment discloses an in-situ swellable packer useable for isolating sections of a wellbore. The in-situ swellable packer comprises a cylindrical body having a backup piece at least at one end of the cylindrical body, a tube. The tube may extend through the cylindrical body and backup piece. The cylindrical body may be made of swellable material expandable vertical to the tube to form an in-situ packer at downhole.

Optionally in any aspect, the backup piece is expandable vertical to the tube upon a trigger action.

Optionally in any aspect, the swellable material comprises an inorganic material.

Optionally in any aspect, the composite material swells on contact with water due to chemical reaction of the composite material.

Optionally in any aspect, the composite material comprises magnesium.

Optionally in any aspect, the oxide further comprises an inert oxide.

Optionally in any aspect, the inert oxide volume percent is from about 20% to about 60%, in one embodiment, from about 10% to about 40%.

Further in another aspect, one embodiment discloses a method for manufacturing swellable compositions suitable for use in subterranean wells. The method comprise steps of admixing a swellable composite material with an oxide to form a premix; adding an inert oxide to the premix to form a mixture; and pressing the mixture to a compact.

Optionally in any aspects, the swellable composite material comprises magnesium, aluminum, or their alloys. Magnesium will react with water to form magnesium hydroxide. The magnesium hydroxide will react with silicate or oxide to form a salt.

Optionally in any aspects, the compact has pores, wherein the pores have porosity from about 0.5% to about 10%.

Optionally in any aspects, the inert oxide volume percent is from about 20% to about 60%.

Dissolvable metals, such as Mg, Al, or their alloys, react with water to form $Mg(OH)_2$ or $Al(OH)_3$, which then reacts with reactive oxide including but limited to active $SiO_2$, $Na_2Si_2O_3$, $Al_2SiO_5$, $Al_2O_3$ etc.

Optionally in any aspects, the inert oxide comprises at least one of silicate, $ZrO_2$, Optionally in any aspects, the method further comprises steps of forming a corrosion resistant seal at the presence of water under high pressure high temperature at downhole.

In yet another aspect, one embodiment discloses a swellable composition suitable for use in subterranean wells. The swellable composition comprises a composite material, wherein the composite material swells on contact with water due to a chemical reaction of the composite material.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

FIG. 1(*b*) illustrates a schematic showing an in-situ swellable packer with two metal backups expandable vertical to the packer according to one embodiment;

FIG. 1(*c*) depicts the in-situ swellable packer expanded to fit the contour of the casing after chemical reactions of the compact according to one embodiment;

DETAILED EMBODIMENTS

Definitions

Figure 1A:
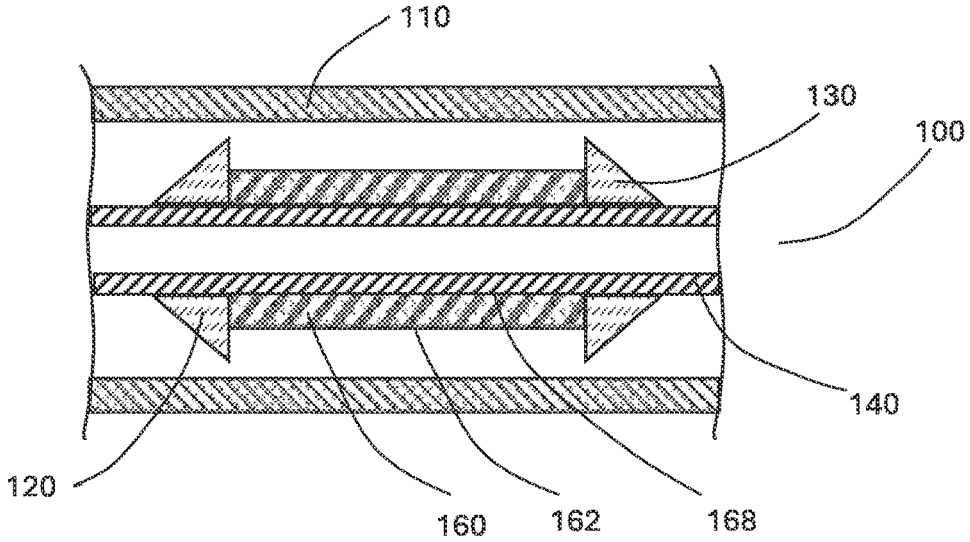
FIG. 1(*a*) illustrates a schematic showing an in-situ swellable packer in use in a casing underground during oil and gas exploration according to one exemplary embodiment.

Unless otherwise indicated, all numbers expressing quantities of ingredients, properties such as size, weight, reaction conditions and so forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

The term "about" means plus or minus 20%, more preferably plus or minus 10%, even more preferably plus or minus 5%, most preferably plus or minus 2%.

The invention is not limited to the particular methodology, protocols, and reagents described herein because they may vary. Further, the terminology used herein is for the purpose of describing particular embodiments only and is not intended to limit the scope of the present invention. As used herein and in the appended claims, the singular forms "a," "an," and "the" include plural reference unless the context clearly dictates otherwise.

Unless defined otherwise, all technical and scientific terms and any acronyms used herein have the same meanings as commonly understood by one of ordinary skill in the art in the field of the invention. Although any methods and materials similar or equivalent to those described herein can be used in the practice of the present invention, the preferred methods, devices, and materials are described herein.

All percentages for weights expressed herein are by weight of the total food product unless specifically stated otherwise.

The technical means, creative features, objectives, and effects of the patent application may be easy to understand, the following embodiments will further illustrate the patent application. However, the following embodiments are only the preferred embodiments of the utility patent application, not all of them. Based on the examples in the implementation manners, other examples obtained by those skilled in the art without creative work shall fall within the protection scope of the present invention. The experimental methods in the following examples are conventional methods unless otherwise specified. The materials and reagents used in the following examples can be obtained from commercial sources unless otherwise specified.

EXEMPLARY EMBODIMENTS

Herein disclosed are novel systems, and methods that pertain to downhole tools usable for wellbore operations, details of which are described herein.

The packer may be suitable for frac operations. In an exemplary embodiment, the packer may be a composite packer made of swellable material, the packer being suitable for use in vertical or horizontal wellbores.

Broadly, the present embodiment discloses method or design to form in-situ swellable packer with a unique formulation and processing that enable packer forming and dissolving functions.

This invention disclosure provides a formulation and deployment method to achieve reliable seal at extremely high temperature where rubber seals degrade readily (>230° C.). More specifically, the disclosed invention provides a formulation to make reactive composite material that can react with downhole fluids to form a super reliable seal material for HTHP corrosive environment. Deployment method is also proposed to use it as a packer or a bridge plug. Various oil service companies tried different routes to manufacture such high temperature seal, but cannot deliver a reliable product with V0 level of sealing performance. Potential applications would be downhole tools (packer, bridge plugs, etc.) used in extremely harsh environment, such as geothermal wells, HTHP gas wells, thermal injection wells, etc.

Figure 1B:
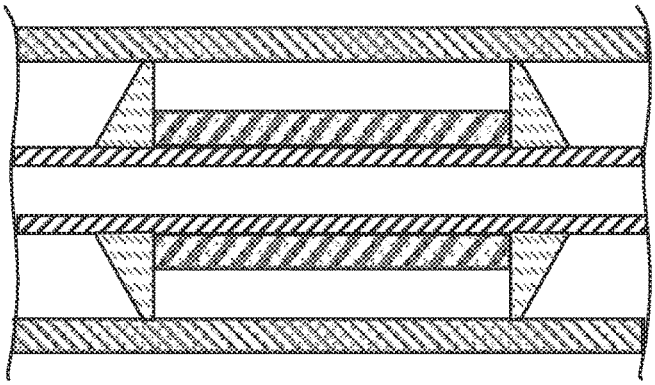

As shown in FIG. 1(*a*), a downhole tool 100 useable for isolating sections of a wellbore 110 may comprise a cylindrical body 160 having a backup piece 120 or 130 at least at one end of the cylindrical body 160; and a tube 140 extends through the cylindrical body 160 and backup piece 120 or 130. The cylindrical body 160 is made of a swellable material. The cylindrical body 160 may comprise an external surface 162, and an inner bore surface 168 formed around the tube 140. The swellable material may be expandable vertical to the tube 140 to form an in-situ manufactured tool downhole.

In another embodiment, the downhole tool 100 may have both a distal end backup piece 120, a proximate end backup piece 130; a tube 140, and a cylindrical body 160.

The tube 140 may extend from the distal end backup piece 120 to the proximate end backup piece 130. The cylindrical body 160 is between the distal end backup piece 120 and the proximate end backup piece 130. The cylindrical body 160 is made of a swellable material, such as a composite material. The composite material swells on contact with water due to chemical reaction of the composite material.

Downhole tools according to embodiments disclosed herein may include one or more anchor slips (not shown), one or more compression cones (not shown) engageable with the slips, and a compressible seal element disposed therebetween, all of which may be configured or disposed around a plug. The tool may include a flow bore open to an end of the tool and extending to an opposite end of the tool. Thus, the tool may be suitable for frac operations. In an exemplary embodiment, the tool may be a composite frac plug made of expendable material, the plug being suitable for use in vertical or horizontal wellbores.

A downhole tool useable for isolating sections of a wellbore may include a first set of threads and a second set of threads (not shown). The downhole tool may include a degradable member disposed about the downhole tool and in engagement with a seal element also disposed about the downhole tool. In accordance with the disclosure, the degradable member may be partially deformable. For example, upon application of a load, a portion of the expendable member, such as a resilient portion, may withstand the load and maintain its original shape and configuration with little to no deflection or deformation. At the same time, the load may result in another portion, such as a deformable portion, such as the backup piece, that experiences a deflection or deformation, to a point that the deformable portion, such as the backup piece, changes shape from its original configuration and/or position to expand vertical to the tube as shown in FIG. 1(*b*).

The downhole tool may include a first slip disposed about the downhole tool and configured for an engagement with the expendable member, such as a composite material, for example. In an embodiment, the first slip may engage an angled surface of a resilient portion of the expandable member. The downhole tool may further include a cone piece disposed about the downhole tool. The cone piece may include a first end and a second end.

The first end may be configured for engagement with the seal element. The downhole tool may also include a second slip, which may be configured for contact with the cone. In an embodiment, the second slip may be moved into an engagement or compression with the second end of the cone during setting. In another embodiment, the second slip may have a one-piece configuration with at least one groove or undulation disposed therein.

In accordance with embodiments of the disclosure, setting of the downhole tool in the wellbore may include the first slip and the second slip in gripping engagement with a surrounding tubular or wellbore 110, the seal element sealingly engaged with the surrounding wellbore 110, and/or application of a load to the plug sufficient enough to shear one of the sets of the threads.

Any of the slips may be made of a composite material or metal (e.g., Mg alloy or Al alloy). Any of the slips may include gripping elements, such as inserts, buttons, teeth, serrations, etc., configured to provide gripping engagement of the tool with a surrounding surface, such as the tubular. In an embodiment, the second slip may include a plurality of inserts disposed therearound. In some aspects, any of the inserts may be configured with a flat surface, while in other aspects, any of the inserts may be configured with a concave surface (with respect to facing toward the wellbore).

The downhole tool (or tool components) may include a longitudinal axis, including a central long axis. During setting of the downhole tool, the deformable portion, such as the proximate end backup piece or the distal end backup piece may expand or "flower", such as in a radial direction away from the axis, as shown in FIGS. 1(*b*) and 1(*c*). Setting may further result in the expandable member and the seal element compressing together to form a reinforced seal or barrier therebetween. In embodiments, upon compressing the seal element, the seal element may partially collapse or buckle around an inner circumferential channel or groove disposed therein.

In an embodiment, one of the sets of threads on the downhole tool 100 may be shear threads. In other embodiments, one of the sets of threads may be shear threads disposed along a surface of the bore at the proximate end. In yet other embodiments, one of the sets of threads may be rounded threads. For example, one of the sets of threads may be rounded threads that are disposed along an external mandrel surface, such as at the distal end. The round threads may be used for assembly and setting load retention.

The downhole tool may be coupled with a setting adapter configured with corresponding threads that mate with the first set of threads. In an embodiment, the downhole tool may be configured for fluid to flow therethrough. The downhole tool may also be coupled with a sleeve configured with corresponding threads that mate with threads on the end of the plug. In an embodiment, the sleeve may mate with the second set of threads. In other embodiments, setting of the downhole tool may result in distribution of load forces along the second set of threads at an angle that is directed away from an axis.

In embodiments, an e-line or wireline mechanism may be used in conjunction with deploying and/or setting the tool. There may be a pre-determined pressure setting; where upon excess pressure produces a tensile load on the downhole tool that results in a corresponding compressive force indirectly between the downhole tool and a setting sleeve. The use of the stationary setting sleeve may result in one or more slips being moved into contact or secure grip with the surrounding tubular, such as a casing string, and also a compression (and/or inward collapse) of the expandable materials. The distal end backup piece and proximate end backup piece may expand vertical to the tube upon this trigger action, such as this compression. The axial compression of the expandable materials may be essentially simultaneous (but not necessarily) to its radial expansion outward and into sealing engagement with the surrounding the wellbore 110 with the external surface 162 in line with the wellbore 110, as shown in FIGS. 1(*b*) and 1(*c*). To disengage the tool from the setting mechanism (or wireline adapter), sufficient tensile force may be applied to the plug to cause mated threads therewith to shear.

In one embodiment, the swellable materials 200 may be a composite material. The composite material, comprising a metal 220, such as Mg, Al, lithium, calcium, or their alloys, for example, swells on contact with water due to chemical reaction of the composite material, as shown below as an example:

$$Mg + 2H_2O \longrightarrow Mg(OH)_2 + H_2$$

The swellable materials 200 may further comprise an inert oxide 230, such as silicate, $ZrO_2$, zeolite, molecular sieves, and mesoporous materials, such as MCM-41, for example. The inert oxide 230 volume percent may be from about 20% to about 60%, for example. In some embodiment, the inert oxide volume percent may be from about 10% to about 40%, for example. In another embodiment, a swellable packer may comprise a swellable sealing element. The swellable sealing element may comprise a metal, metal alloy, or a combination thereof; and a geopolymer, such as a clay. The swellable sealing element may be configured to react with a brine or water to form a metal hydroxide reaction product which forms a permanent seal with an adjacent surface.

In one embodiment, the metal is selected from the group consisting of magnesium, copper, aluminum, zinc, nickel, Gd, and any combination thereof. In another embodiment, the metal alloy comprises a metal selected from the group consisting of magnesium, copper, aluminum, zinc, nickel, Gd, and any combination thereof.

In one embodiment, the swellable sealing element comprises about 0.05 wt % to about 3.00 wt % Copper or Nickel or Zinc. The swellable sealing element may further comprise from about 0.01 wt % to about 10 wt % geopolymer and a balance of Mg. In one embodiment, an alloy may comprise about 0.15 wt % nickel, about 1.4 wt % copper, about 3.1 wt % gadolinium, about 4.0 wt % yttrium, and the balance magnesium, for example.

Figure 1C:
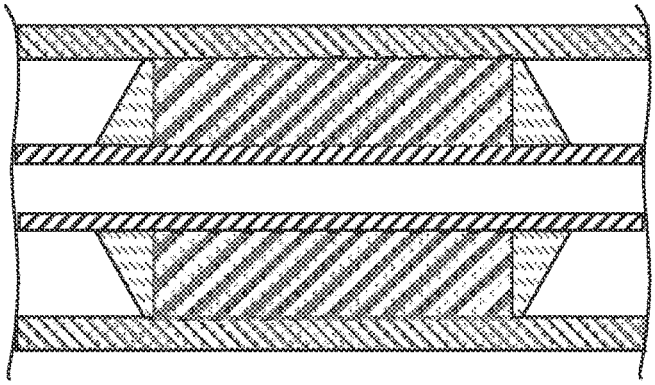
Figure 2:
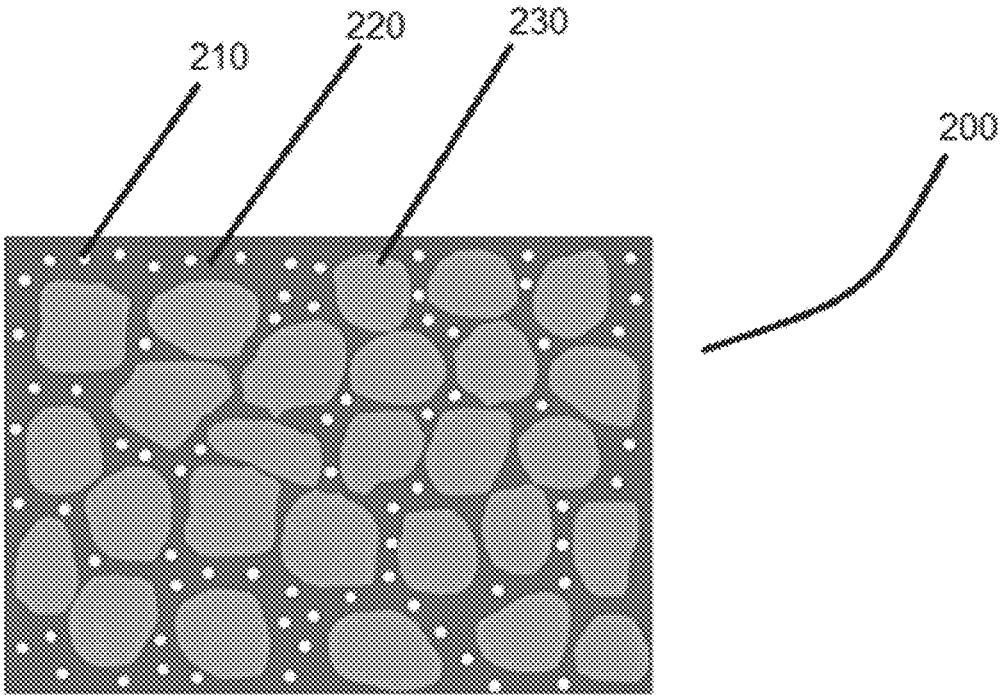
FIG. 2 schematically depicts a swellable composition.

Still in FIG. 2, a system for forming a seal in a wellbore may comprise a swellable packer. The swellable packer may comprise about 0.01 wt % to about 10 wt % geopolymer 210 and a conduit (or wellbore casing 110 as shown in FIG. 1(*a*)). The swellable packer is disposed on the conduit. The swellable sealing element is configured to irreversibly react with a brine to form a metal hydroxide reaction product which forms a permanent seal with an adjacent surface.

In one embodiment, the swellable packer further comprises a swellable sealing element comprising a metal, metal alloy, or a combination thereof. In one embodiment, the swellable sealing element comprises about 0.05 wt % to about 3.00 wt % Copper or Nickel or Zinc, with a balance of Mg.

In another embodiment, the swellable packer may also comprise an external sleeve, or a porous layer, that is disposed about the swellable metal sealing element. The swellable packer is wrapped or slipped on the tube 140 or a base pipe with weight, grade, and connection specified by the well design. The tube 140 may be any type of conduit used in a wellbore, including drill pipe, stick pipe, tubing, coiled tubing, etc. The swellable packer further comprises end rings (not shown). End rings protect the swellable metal sealing element as it is run to depth. End rings may create an extrusion barrier, preventing the applied pressure from extruding the seal formed from the swellable metal sealing element in the direction of said applied pressure. In some examples, end rings may comprise a swellable metal and may thus serve a dual function as a swellable metal sealing element analogously to swellable metal sealing element. In some examples, end rings may not comprise a swellable metal or any swellable material. It is to be understood that end rings 150 are optional components in all examples described herein, and are not necessary for any swell packer described herein to function as intended.

Figure 3:
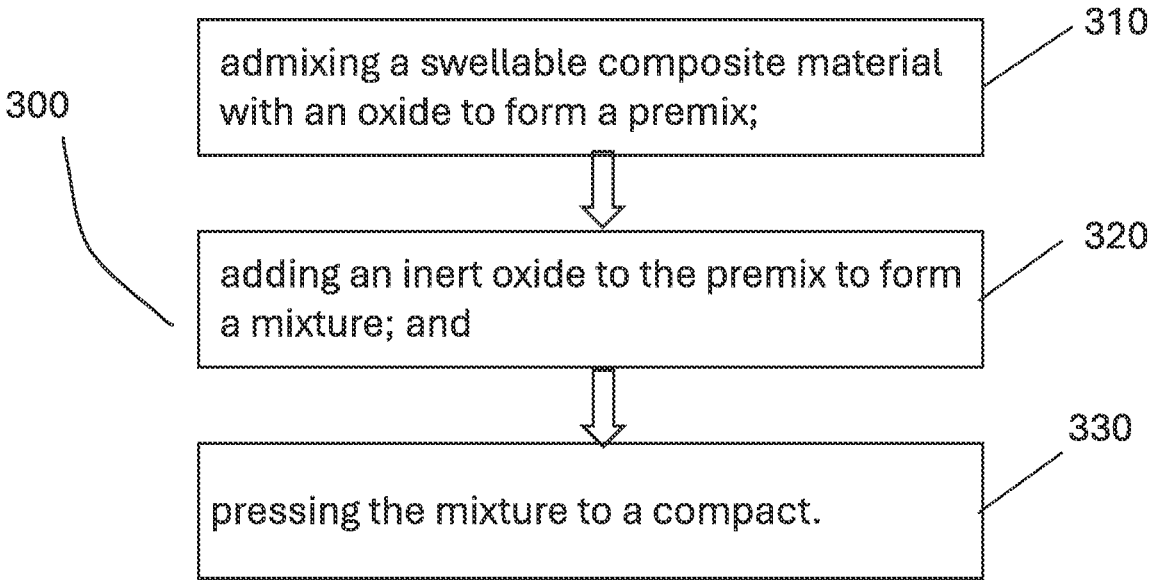
FIG. 3 illustrates a flow chart of method of making in-situ swellable downhole tool according to one embodiment.

As shown in FIG. 3, in one embodiment, a method 300 for manufacturing swellable compositions suitable for use in subterranean wells may comprise steps of admixing a swellable composite material with an oxide, such as a geopolymer, to form a premix in step 310; adding an inert oxide to the premix to form a mixture in step 320; and pressing the mixture to a compact in step 330.

In the step 310, the swellable composite material may include dissolvable metal powder, such as Mg, Al, lithium, calcium, or their alloys powder, for example. The reactive oxide may include silicon oxide, $Na_2Si_2O_3$, $Al_2SiO_5$, $Al_2O_3$, for example. The inert oxide may include silicate, $ZrO_2$, zeolite, molecular sieves, and mesoporous materials. In the step 330, hot press, cold press, or hot isostatic pressing (HIP) may be used.

More specifically, dissolvable Mg or Mg alloy powder is blended evenly with $SiO_2$ powder first to form a premix. An inert oxide is then added to get premix. This mixture is put into a mold and compressed at desirable temperature and pressure to get a compact with a desirable porosity. Certain porosity may be favored for water to diffuse, and to increase reaction rate. A compact of too high porosity will not have enough mechanical strength. Mg and $SiO_2$ mole fraction is from about 0.5 to about 2, for example. The inert oxide volume percent may be from about 20% to about 60%, for example. Porosity of final composite is controlled from about 0.5% to about 10%, for example. The press temperature is from about room temperature to about 700° C., for example. In addition, the compressing pressure may be from about 500 to about 5000 psi, for example.

Dissolving rate of Mg alloy may be above >20 mg/cm$^2$/hr. Size of both Mg and $SiO_2$ powder may be below 500 μm, for example, to get enough reaction rate. Inert oxide size may be from about 100 μm to about 3 mm, for example, for strength enhancement.

In one embodiment, the method 200 may further comprise step of forming a corrosion resistant seal at the presence of water under high pressure high temperature at downhole, as shown the chemical reaction below as an example:

$$3Mg(OH)_2 + 4SiO_2 \longrightarrow Mg_3Si_4O_{10}(OH)_2 + 2H_2O$$

$$Mg(OH)_2 + \text{Aluminosilicate} + H_2O \longrightarrow$$

$$\text{Magnesium Silicate Hydrate} + \text{Other Reaction Products}$$

$$Mg(OH)_2 + Na_2SiO_3 \longrightarrow MgSiO_4 + 2\,NaOH$$

$$Mg(OH)_2 + Al_2O_3 \longrightarrow MgAl_2O_4 + 2\,H_2O$$

$$Al(OH)_3 + Na_2SiO_4 \longrightarrow NaAl(SiO_4)_2 + 2\,H_2O$$

$$Mg(OH)_2 + CaCO_3 \longrightarrow CaMg(CO_3)_2Al_2O_3 + 2SiO_2 \longrightarrow Al_2Si_2O_5(OH)_4, + 2\,H_2O$$

$$2CaCO_3 + Mg \longrightarrow CaMg(CO_3)_2 + Ca$$

In the downhole condition, dissolvable metal reacts with water very fast and provide $Mg(OH)_2$ resource continuously. Besides, the dissolving process generates tremendous amount of heat since it is an exothermic reaction, which also accelerates reaction rate. The field observation shows that the crystallization process happens mainly in high temperature wells or fast dissolving alloys. It is consistent with literature report and lab test of this reaction. $SiO_2$ source is believed to come from hydraulic sand or formulation.

The reaction of MgO with a soluble source of silica generally forms a poorly crystalline talc-like or serpentine-like phase, the precise structure of which is still under investigation and appears to depend significantly on the Mg/Si ratio.

Modern M-S-H (magnesium-silicate-hydrate) cements are generally formed from a source of magnesium (typically MgO) and a source of highly reactive silica (e.g., silica fume) in situ, rather than forming from the hydration of a magnesium silicate clinker, because magnesium silicates are non-hydraulic. Non-hydraulic cement is cement which cannot harden while in contact with water.

Product of these reactions may be TALC or other materials, as shown below table, which is believed to be a great bonding/cementing material. TALC is finally bonded to inert oxide, such as silicate, $ZrO_2$, for example, to form this hard and corrosion resistant seal materials. It can thus bond sand or other mineral together to form this super-hard recrystallized product, like a cement material. Since TALC is hard and brittle, sand is required to provide enough compressive strength. Based on lab test, it is resistant to all acid environment that could possibly exist in downhole.

| mineral | group | formulation |
|---|---|---|
| lizardite | serpentine | $Mg_3(Si_2O_5)(OH)_4$ |
| antigorite | serpentine | $Mg_3(Si_2O_5)(OH)_4$ |
| chrysotile | serpentine | $Mg_3(Si_2O_5)(OH)_4$ |
| sepiolite | phyllosilicate | $Mg_4(Si_6O_{15})(OH)_2 \bullet 6H_2O$ |
| saponite | phyllosilicate | $Ca_{0.25}(Mg,Fe)_3((Si,Al)_4O_{10})(OH)_2 \bullet nH_2O$ |
| talc | phyllosilicate | $Mg_3(Si_4O_{10})(OH)_2$ |

In use, take a packer as an example, reactive compact may be mounted on a tube with metal backup at least one of two ends (FIG. 1(*a*)). When the tool reaches the position, backup metal piece is expanded to touch casing, creating a stagnant environment for reactive composite (FIG. 1(*b*)). Stagnant environment may be critical for continuous reaction. It should allow water to flow, but trap reacted material in the closed environment. In this limited space, reactive compact may react and absorb water, and finally form recrystallized seal (FIG. 1(*c*)).

In another embodiment, a method for forming a seal in a wellbore may comprise steps of providing a swellable packer comprising a swellable metal sealing element having a first volume; wherein the swellable packer is disposed on a conduit in the wellbore, wherein the swellable metal sealing element comprises a geopolymer, such as clay, exposing the swellable metal sealing element to a brine to irreversibly react the swellable metal sealing element with brine to produce a metal hydroxide reaction product having a second volume greater than the first volume, and contacting a surface adjacent to the swellable metal sealing element with the metal hydroxide reaction product to form a permanent seal with the metal hydroxide reaction product.

In one embodiment, the adjacent surface may be a wall of the wellbore, as shown in FIG. 1(*a*). The geopolymer may be about 0.01 wt % to about 10 wt %, for example. In one embodiment, the swellable packer further comprises about 0.05 wt % to about 3.00 wt % Copper or Nickel or Zinc, with a balance of Mg. In one embodiment, the geopolymer comprises montmorillonite.

In one embodiment, the method for forming a seal in a wellbore further comprises a step of inducing mineralization under high temperature and high pressure.

Using a packer as an example, a reactive composite tube is mounted on a mandrel with metal backups positioned at both ends (FIG. 2*a*). Once the tool reaches the target position, the backups are expanded to contact the casing, creating a stagnant environment around the reactive composite material (FIG. 2*b*). Establishing this stagnant environment is critical for sustaining the reaction; it permits water ingress while retaining the reacted material within the enclosed space. Within this confined environment, the reactive composite continues to react and absorb water (as illustrated in FIG. 1), ultimately forming a recrystallized seal (FIG. 1*c*).

Experiments have shown that the reaction described by Equation 1 is highly reliable for sealing applications, due to the significant volume expansion resulting from the chemical conversion of magnesium alloy to $Mg(OH)_2$.

$$Mg + 2H_2O \longrightarrow Mg(OH)_2 + H_2 \quad \text{Equation 1}$$

$$3Mg(OH)_2 + 4SiO_2 \longrightarrow Mg_3Si_4O_{10}(OH)_2 + 2H_2O \quad \text{Equation 2}$$

This conversion leads to approximately a 78% increase in volume. In contrast, the reaction described by Equation 2, involving the interaction between $Mg(OH)_2$ and $SiO_2$, is much more difficult to achieve under typical well temperatures due to the inherently low reaction rate between two solid phases. Although the addition of finely sized silicate and aluminate particles can accelerate this reaction, it remains slow and highly sensitive to environmental conditions, which negatively impacts the reliability of the final tool. Therefore, sealing performance relies entirely on the reaction described in Equation 1, making it highly suitable for high-temperature, niche applications.

Figure 4:
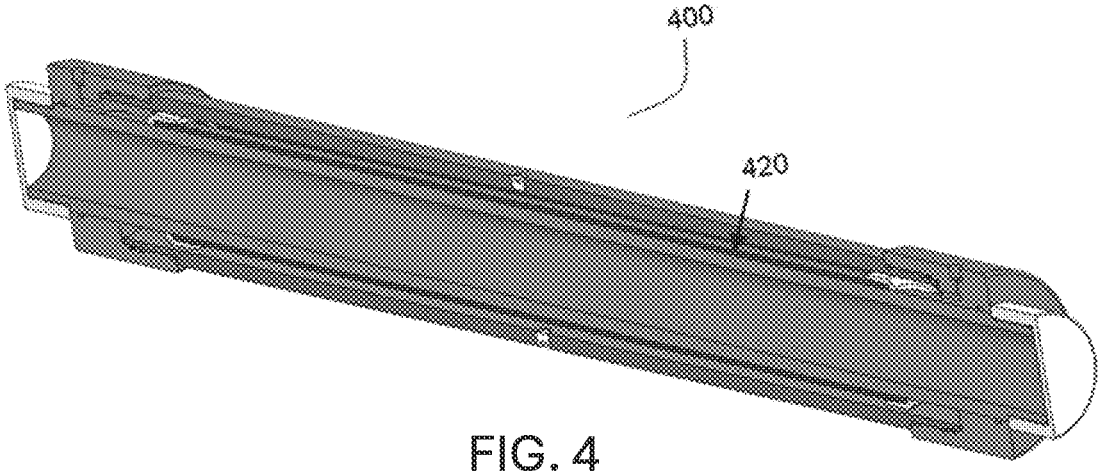
FIG. 4 shows design and testing setups of the recrystallization packer according to one embodiment.
Figure 5:
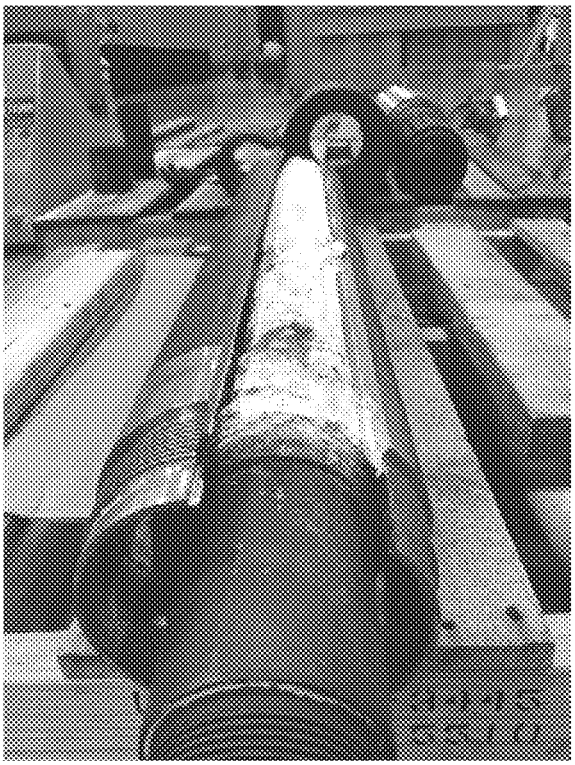
FIG. 5 shows image of the recrystallization packer after the testing casing was split open.

To validate the concept, a packer and a corresponding testing setup were built, as shown in FIG. 4*a*. A confined space is essential for the successful formation of this recrystallized seal. As depicted in FIG. 4, dissolvable magnesium alloy 420 initially reacts with water to form $Mg(OH)_2$. Within a closed environment, $Mg(OH)_2$, which has very low solubility in water, begins to pack and self-energize due to the significant volume expansion, a critical requirement for an effective seal. Without a confined space, even though the solubility of $Mg(OH)_2$ in water remains low, the newly formed material can still be carried away by fluid flow, preventing recrystallization and energy buildup. To address this, a cap is placed at the end of the casing to create the necessary enclosed environment, as shown in FIG. 4. FIG. 5 shows images of the recrystallization packer after the testing casing was split open.

Figure 6:
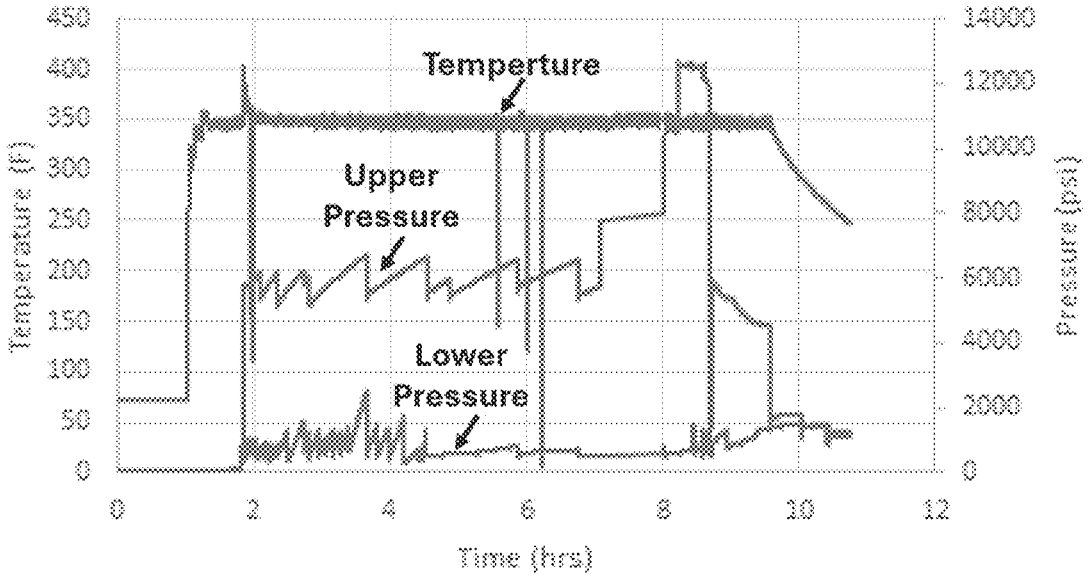
FIG. 6 shows pressure test results of the recrystallization packer as shown in FIG. 4.

Testing was conducted at 175° C. following a 12-hour hold period to allow complete dissolution of the magnesium (FIG. 6). After four hours of maintaining the upper zone at 5000 psi, it was observed that both the upper and lower zones sustained a stable 5000 psi differential pressure. Based on this result, the target pressure was increased to 7500 psi for an additional one-hour hold, which was successfully maintained without leakage. Subsequently, a brief 10,000 psi hold for 30 minutes also showed no signs of leakage. Finally, the pressure was increased to 12,500 psi for another 30-minute hold, which the system withstood successfully. These results clearly demonstrate that the energized $Mg(OH)_2$ material can effectively function as a sealing element.

After testing, the casing was split open to examine the formed seal (FIG. 5). The results show that the $Mg(OH)_2$ completely filled the gap between the tubing and casing and formed a strong bond to the casing surface. SEM characterization of the inner wall of the casing revealed residual bonded $Mg(OH)_2$, confirming adhesion. On the sealing material side, the surface appeared dense and smooth, providing a near-perfect replica of the casing's inner wall. These observations directly support the previously discussed concepts of recrystallization and self-energization of the sealing material.

XRD analysis of the sealing material shows that the majority phase is $Mg(OH)_2$, with a small amount of MgO present due to the condensation of $Mg(OH)_2$. The formation of MgO helps prevent further reaction between water and the underlying Mg alloy core. Additionally, the results suggest that $H_2O$ molecule diffusion through the recrystallized $Mg(OH)_2$ seal is effective, which is a desirable characteristic for maintaining a robust and reliable seal.

Despite its excellent sealing performance and high-temperature capability, this sealing concept is suitable primarily for niche markets due to the inherent limitations of the sealing material, $Mg(OH)_2$. As a basic material, $Mg(OH)_2$ is not suitable for long-term downhole applications where acidic environments are expected, such as in the presence of $CO_2$, $H_2S$, or during operations like acidizing or acid fracturing. Therefore, this unique sealing approach is best suited for the following applications:

1. Temporary Seal

Figure 7:
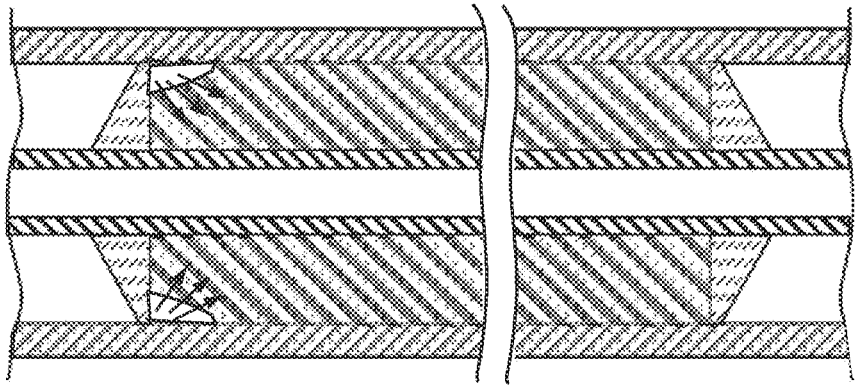
FIG. 7 shows schematic illustration of gradual etching process of recrystallized $Mg(OH)_2$ sealing materials during operation.

Although $Mg(OH)_2$ is reactive in acidic environments, it does not present an issue when used as a temporary seal or barrier material. These applications include multistage fracturing, workover plugs, lost circulation blocking, and similar uses. As illustrated in FIG. 7, since the sealing material is long and enclosed, corrosion and reaction (i.e., etching) begin at one end of the sealing element. Due to the presence of a backup, as shown in FIG. 7, etching is confined to the edge. As a result, the etching rate is extremely low, allowing the operation to be completed—typically within hours or days—with a large safety margin.

2. Long Term Application in Mild Condition to the $Mg(OH)_2$, which Includes but not Limited to:

2.1 Oil Production with Low Water Cut

Since only water and dissolved acids react with $Mg(OH)_2$, while organic petroleum fluids do not interact with $Mg(OH)_2$, this unique packer material is ideal for use in open-hole applications in petroleum production. The stability of $Mg(OH)_2$ in the presence of non-aqueous petroleum fluids ensures that the packer maintains its sealing integrity over time, even in conditions where water cut is low. This makes it a reliable choice for environments where minimal water production is expected, providing effective sealing without the risk of degradation from the crude oil.

2.2 Sweet Downhole Condition $CO_2$ is the primary contributor to downhole acidic conditions. However, this does not pose a significant issue for the unique packer made from $Mg(OH)_2$. The reaction between dense $Mg(OH)_2$ and $CO_2$ is very slow, and even when they do react, they form $MgCO_3$, which has a lower solubility than $Mg(OH)_2$ and a larger volume. This expansion further enhances the sealing properties of the material, making $MgCO_3$ even more effective than $Mg(OH)_2$ as a sealing agent.

Figure 8:
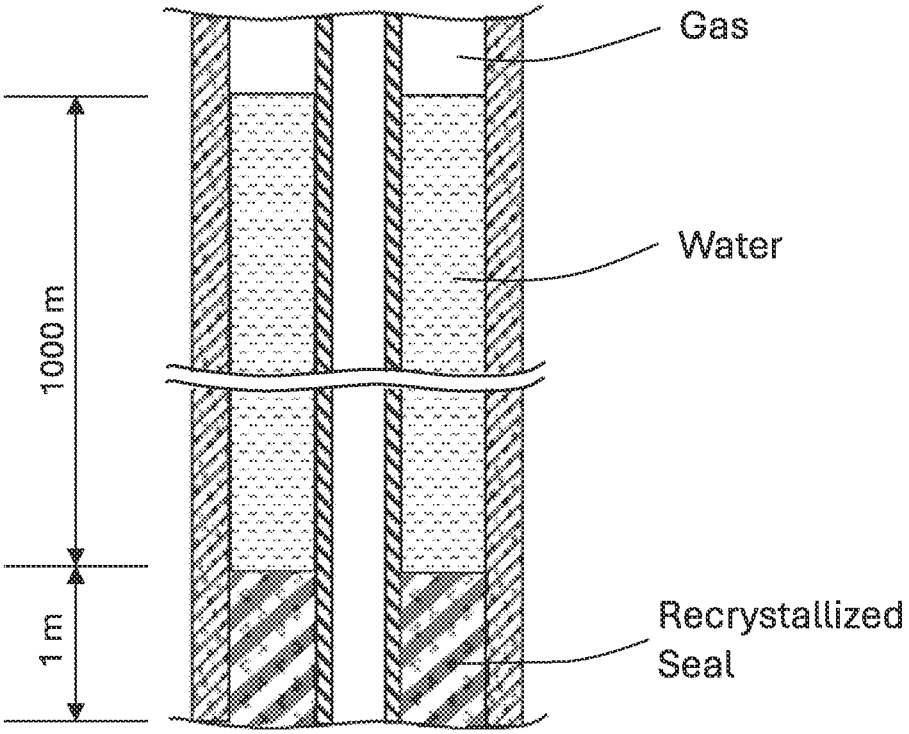
FIG. 8 shows schematic illustration of the downhole simulation process with a recrystallized seal used as a packer.
Figure 9A:
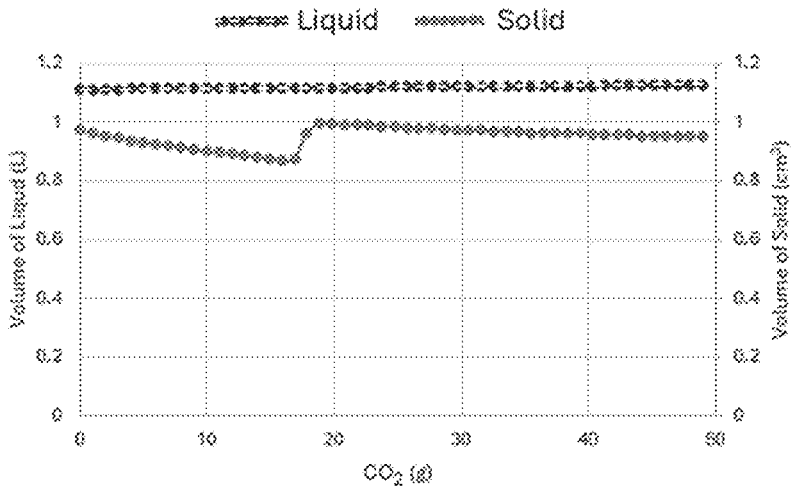
FIG. 9*a* illustrates OLI Studio simulation results with top gas as $CO_2$. The simulation was conducted at a temperature of 230° C. and a pressure of 15 ksi.

Simulation results using OLI Studio, which models the crystallized packer as a permanent production packer, are shown in FIG. 8. In this simulation, the packer is designed to be 1 meter long, with a 1000-meter water column between the casing and an overlying gas phase. Under sweet conditions, where only $CO_2$ is present, the simulation was run at 230° C. and 15 ksi, with the results shown in FIG. 9*a*. As $CO_2$ increases, the volume of the solid phase remains relatively stable. The noticeable bump at around 19 g of $CO_2$ represents the complete conversion of $Mg(OH)_2$ to $MgCO_3$, confirming that the recrystallized $Mg(OH)_2$ is highly suitable for sweet downhole conditions.

Figure 9B:
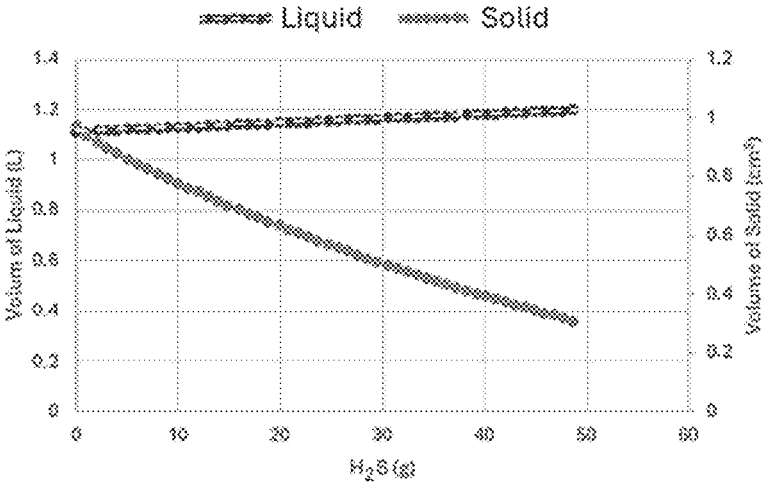
FIG. 9*b* illustrates OLI Studio simulation results with top gas as $H_2S$. The simulation was conducted at a temperature of 230° C. and a pressure of 15 ksi.

On the other hand, in sour conditions, primarily caused by the presence of $H_2S$, the packer is not suitable. The simulation results show that $Mg(OH)_2$ reacts with $H_2S$ to form MgS, which has a higher solubility in water. As a result, the $Mg(OH)_2$ packer would gradually degrade in sour environments. The simulation results for sour conditions, with $H_2S$ as the top gas (FIG. 8), are shown in FIG. 9*b*. As $H_2S$ concentration increases, the solid volume decreases progressively, confirming that $Mg(OH)_2$ is gradually etched away in the presence of $H_2S$.

2.3 Storage Well

Storage wells are used to store petroleum, natural gas, hydrogen, and even air, and are commonly referred to as energy storage wells. In these applications, water is typically absent, which eliminates the possibility of $Mg(OH)_2$ elements being etched. As a result, these conditions present a highly suitable and promising application for $Mg(OH)_2$-based sealing materials.

The above shows and describes the basic principles, main features and advantages of the utility patent application. Those skilled in the industry should understand that the present utility patent application is not limited by the above-mentioned embodiments. The above-mentioned embodiments and the description are only preferred examples of the present utility patent application and are not intended to limit the present utility patent application, without departing from the present utility patent application. Under the premise of spirit and scope, the present utility patent application will have various changes and improvements, and these changes and improvements fall within the scope of the claimed utility patent application. The scope of protection claimed by the utility patent application is defined by the appended claims and their equivalents.

We claim:

1. An in-situ swellable downhole tool useable for isolating sections of a wellbore, comprising:

a cylindrical body having a backup piece at least at one end of the cylindrical body; and a tube extends through the cylindrical body and the backup piece;

wherein the cylindrical body is made of a swellable material expandable vertical to the tube to form an in-situ packer at downhole, wherein the swellable material comprises a composite material comprising a metal selected from the group consisting of magnesium, aluminum, and their alloys, and an oxide comprising at least one of silicon oxide, $Na_2Si_2O_3$, $Al_2SiO_5$, and $Al_2O_3$; and wherein the composite material is configured to react with water to form a metal hydroxide reaction product that mineralizes in situ to form a recrystallized seal at downhole conditions.

2. The tool as claimed in claim 1, wherein the composite material swells on contact with water due to chemical reaction of the composite material to form a metal hydroxide that subsequently reacts with the oxide to form a mineralized recrystallized product.

3. The tool as claimed in claim 2, wherein the oxide is a reactive oxide selected from the group consisting of silicon oxide, $Na_2Si_2O_3$, $Al_2SiO_5$, $Al_2O_3$, and combinations thereof, and wherein the reactive oxide reacts with the metal hydroxide reaction product to form a mineralized seal.

4. The tool as claimed in claim 3, wherein the oxide comprises a geopolymer, wherein the geopolymer comprises clay selected from the group consisting of montmorillonite, kaolinite, and combinations thereof, and wherein the geopolymer is present in an amount of about 0.01 wt % to about 10 wt % based on the total weight of the composite material.

5. The tool as claimed in claim 2, wherein the composite material further comprises a reactive oxide in a molar ratio of $Mg:SiO_2$ from about 0.5 to about 2.

6. The tool as in claim 2, wherein the composite material further comprises an inert oxide, wherein the inert oxide is selected from the group consisting of silicate, $ZrO_2$, zeolite, molecular sieves, mesoporous materials, and combinations thereof; and wherein the inert oxide volume percent is from about 20% to about 60%.

7. The tool as in claim 6, wherein the inert oxide volume percent is from about 10% to about 40%, and wherein the composite material has a porosity from about 0.5% to about 10%, the porosity being configured to allow water to diffuse into the composite material while maintaining sufficient mechanical strength for downhole application.

8. A method for forming a seal in a wellbore comprising: providing a cylindrical body having a backup piece, wherein the cylindrical body comprises a swellable metal sealing element having a first volume; wherein the cylindrical body is disposed on a conduit in the wellbore, and wherein the swellable metal sealing element comprises a composite material comprising a metal selected from the group consisting of magnesium, aluminum, and their alloys, and a reactive oxide selected from the group consisting of silicon oxide, $Na_2Si_2O_3$, $Al_2SiO_5$, $Al_2O_3$, and combinations thereof, exposing the swellable metal sealing element to water to irreversibly react the swellable metal sealing element with the water to produce a metal hydroxide reaction product having a second volume greater than the first volume, and wherein the metal hydroxide reaction product further reacts with the reactive oxide to form a mineralized recrystallized product under high temperature high pressure downhole conditions, and contacting a surface adjacent to the swellable metal sealing element with the metal the mineralized recrystallized product to form a seal to form a seal.

9. The method of claim 8, wherein the swellable metal sealing element comprising a metal selected from the group consisting of calcium, copper, nickel, zinc, and any combination thereof.

10. The method of claim 8, wherein the adjacent surface is a wall of the wellbore.

11. The method of claim 8, wherein the swellable metal sealing element comprises a geopolymer in an amount of about 0.01 wt % to about 10 wt %, and wherein the geopolymer comprises clay selected from the group consisting of montmorillonite, kaolinite, and combinations thereof.

12. The method of claim 11, wherein the geopolymer comprises clay, and wherein the clay is montmorillonite present in an amount that provides improved sealing performance under high temperature high pressure conditions compared to a composition without the clay.

13. The method of claim 8, wherein the swellable metal sealing element comprises about 0.05 wt % to about 3.00 wt % Copper or Nickel or Zinc, wherein the swellable metal sealing element further comprises a balance of Mg; and wherein the Copper, Nickel, or Zinc is present to control the dissolution rate of the swellable metal sealing element in water.

* * * * *